US012757932B2

(12) United States Patent
Bouchuiguir

(10) Patent No.: US 12,757,932 B2
(45) Date of Patent: Oct. 13, 2026

(54) AEROSOL GENERATING SYSTEM AND METHOD OF USING SAME

(71) Applicant: JT International SA, Geneva (CH)

(72) Inventor: Layth Sliman Bouchuiguir, Bellevue (CH)

(73) Assignee: JT International SA, Geneva (CH)

( * ) Notice: Subject to any disclaimer, the term of this patent is extended or adjusted under 35 U.S.C. 154(b) by 395 days.

(21) Appl. No.: 18/283,302

(22) PCT Filed: Mar. 17, 2022

(86) PCT No.: PCT/EP2022/056971
§ 371 (c)(1),
(2) Date: Sep. 21, 2023

(87) PCT Pub. No.: WO2022/200165
PCT Pub. Date: Sep. 29, 2022

(65) Prior Publication Data

US 2024/0164440 A1 May 23, 2024

(30) Foreign Application Priority Data

Mar. 22, 2021 (EP) ..... 21163958

(51) Int. Cl.
*A24F 47/00* (2020.01)
*A24F 15/01* (2020.01)
(Continued)

(52) U.S. Cl.
CPC ..... *A24F 15/01* (2020.01); *A24F 40/49* (2020.01); *A24F 40/53* (2020.01); *A24F 40/65* (2020.01)

(58) Field of Classification Search
CPC ..... A24F 15/01; A24F 15/015; A24F 40/95
See application file for complete search history.

(56) References Cited

U.S. PATENT DOCUMENTS

2015/0102777 A1* 4/2015 Cooper ..... H02J 7/70 320/137
2015/0245654 A1* 9/2015 Memari ..... A24F 40/95 141/2

(Continued)

FOREIGN PATENT DOCUMENTS

CN 106163307 A 11/2016
CN 107105767 A 8/2017

(Continued)

OTHER PUBLICATIONS

International Search Report for Application No. PCT/EP2022/056971 mailed Jul. 27, 2022, pp. 1-6.

*Primary Examiner* — Eric Yaary
(74) *Attorney, Agent, or Firm* — Lerner David LLP

(57) ABSTRACT

An aerosol generating system (10) comprises a case (12) and a vaporizer (14), the case (12) having authentication means adapted to enable removal of the vaporizer (14) from the case (12) only in the event of a positive authentication result and/or disable removal of the vaporizer (14) from the case (12) in the event of a negative authentication result. In a method of using an aerosol generating system (10) comprising a case (12) and a vaporizer (14) removal of the vaporizer (14) from the case (12) is enabled only in the event of a positive authentication result obtained from authentication means and/or disabled in the event of a negative authentication result.

23 Claims, 2 Drawing Sheets

(51) Int. Cl.

| | |
|---|---|
| ***A24F 40/49*** | (2020.01) |
| ***A24F 40/53*** | (2020.01) |
| ***A24F 40/65*** | (2020.01) |

(56) References Cited

U.S. PATENT DOCUMENTS

| | | | | |
|---|---|---|---|---|
| 2017/0099876 | A1 | 4/2017 | Keen | |
| 2018/0271149 | A1 | 9/2018 | Holtz et al. | |
| 2018/0295890 | A1 | 10/2018 | Smayda | |
| 2020/0214341 | A1* | 7/2020 | McKenzie | B65D 5/0085 |
| 2020/0288786 | A1* | 9/2020 | Niebling | A61K 9/0073 |
| 2020/0345948 | A1 | 11/2020 | Schader et al. | |
| 2021/0011446 | A1 | 1/2021 | Anderson et al. | |
| 2021/0251297 | A1 | 8/2021 | Qiu et al. | |
| 2024/0099366 | A1* | 3/2024 | Masih-Ud-Din | A45C 11/00 |

FOREIGN PATENT DOCUMENTS

| | | | |
|---|---|---|---|
| CN | 111542358 | A | 8/2020 |
| CN | 111771198 | A | 10/2020 |
| JP | 2000116370 | A | 4/2000 |
| JP | 3073255 | U | 11/2000 |
| JP | 2017513513 | A | 6/2017 |
| JP | 2017533717 | A | 11/2017 |
| JP | 2021508457 | A | 3/2021 |
| KR | 20160129024 | A | 11/2016 |
| KR | 20180070514 | A | 6/2018 |
| KR | 20180114825 | A | 10/2018 |
| WO | 2016075028 | A1 | 5/2016 |
| WO | 2020087598 | A1 | 5/2020 |
| WO | 2020132127 | A1 | 6/2020 |
| WO | 2020199209 | A1 | 10/2020 |
| WO | 20200234165 | A1 | 11/2020 |
| WO | 2021009022 | A1 | 1/2021 |

* cited by examiner

AEROSOL GENERATING SYSTEM AND METHOD OF USING SAME

CROSS-REFERENCE TO RELATED APPLICATIONS

The present application is a national phase entry under 35 U.S.C. § 371 of International Application No. PCT/EP2022/056971, filed Mar. 17, 2022, published in English, which claims priority to European Application No. 21163958.8, filed Mar. 22, 2021, the disclosures of which are incorporated herein by reference.

TECHNICAL FIELD

The invention relates to an aerosol generating device and a method of using same.

TECHNICAL BACKGROUND

Aerosol generating devices have become popular as a replacement for conventional smoking articles, such as cigarettes. In such devices, it is desirable to prevent unintended usage.

PRIOR ART

In this context, US 2018 0271149 A1 teaches authentication of the cartridge, and the vaping device is only enabled for vaping in case of a positive authentication result. Similar teachings are derivable from WO 2020 0234165 A1 and WO 2020 132127 A1.

SUMMARY OF THE INVENTION

Nevertheless, there remains a need to prevent unintended usage in a more reliable manner.

This is achieved by means of the aerosol generating system described in claim 1.

Accordingly, the case has authentication means adapted to enable removal of the vaporizer from the case only in the event of a positive authentication result and/or disable removal of the vaporizer from the case in the event of a negative authentication result. In other words, the invention relies on the idea to not only charge the battery and/or enable the vaporizer for vaping depending on the authentication result, but the vaporizer can be blocked from being removed from the case unless there is a positive authentication result. In the event of a negative authentication result removal of the vaporizer is disabled and/or only in the event of a positive authentication result, removal of the vaporizer is enabled.

Moreover, removal can be disabled as soon as the vaporizer is placed in the case and as long as there is no positive authentication result. This reliably prevents unintended usage, and it is particularly easy to understand as the vaporizer can be used when it is outside the case, and authentication is necessary to remove it from the case. This particularly provides advantages over any systems, and which any authentication system might be on the vaporizer itself. In accordance with the invention, the authentication means provided on the case can for example be a lock enabling and disabling removal. The case can advantageously be portable and can, as mentioned, be adapted to charge the vaporizer and can additionally be adapted to for example clean the vaporizer.

Generally, the type and shape of the case, to which the invention can be applied, is flexible. In particular, any kind of doors or lids allowing access to the vaporizer can be provided, but the vaporizer can also be held to or nested in the case without being covered in any manner and can for example be held by magnets and/or friction only. In this case, any movement, which is necessary in order to allow removal of the vaporizer from the case, can be blocked. This can be a movement simply separating the vaporizer from the case, so that the vaporizer is firmly held in the nested or attached state. However, when the movement for taking the vaporizer from the case for example starts with a tilting movement, only the tilting movement can be blocked. As long as the vaporizer is completely nested within the case, and no portion of the vaporizer allows grasping the same, removal will still be disabled in accordance with the teaching given herein. The previously indicated types of blocking movement also apply to any doors, lids, sliders or similar components which allow access to the vaporizer in case of a positive authentication result.

Preferred embodiments are described in the further claims.

It will provide further user benefit, when the system has at least one authentication interface provided on the case and/or a mobile device such as a phone. This can for example be a fingerprint reader and/or Bluetooth means for communicating with any device adapted to provide an authentication signal. Such signals can also be exchanged in a wireless manner when the authentication interface is for example provided on a mobile device. Finally, the authentication interface can include display needs, such as a light for indicating a positive authentication result, for example by a green light.

As already indicated above, the authentication interface can for example be based on RFID, Bluetooth and/or biometric detection, such as a fingerprint.

Removal of the vaporizer can for example be disabled by an element having a shape memory alloy and/or an electric lock having at least one magnet, solenoid and/or motor adapted to actuate the lock by electric power being supplied or removed. All of these embodiments are easy to implement and reliably provide locking of the vaporizer.

In particular, an easy to implement locking or blocking element can be provided, which engages the vaporizer and/or a door associated with the chamber or recess accommodating the vaporizer and/or blocks movement thereof. In this manner, access to the vaporizer and/or its removal can be prevented by simple means.

As one of the previously mentioned approaches, removal of the vaporizer is disabled by at least one first locking or blocking element engaging the vaporizer and/or blocks movement thereof. This configuration is in particular useful for blocking the vaporizer itself, for example for a configuration wherein the case comprises no additional door or lid for accessing the vaporizer.

According to an embodiment, the vaporizer comprises a recess, in particular a groove or a hole, and the locking or blocking element is a pin which can enter the recess. Thus, removal of the vaporizer can be securely blocked by the pin engaging the groove.

In particular, the pin is slidable within the case and can be slid into a position protruding into the recess, which provides a reliable and secure mechanism.

According to another embodiment, removal of the vaporizer is disabled by at least one second locking or blocking element engaging a door or lid associated with a chamber or recess accommodating the vaporizer and/or blocks movement thereof. The door or lid of the case may provide access to the vaporizer. If the second locking or blocking element engaging the door or lid, access to the vaporizer is reliably prohibited.

The first and/or second locking or blocking element can be slidable and/or pivotable, both of which are easy to implement.

Reliability of prevention of unintended usage is further improved by the authentication means being adapted to disable removal of the vaporizer after a predetermined time after its detection within the case. In other words, when the vaporizer is placed in the case, it will be blocked against removal after a certain time gap and until there is a positive authentication result. The predetermined time can for example range from 1 to 60 minutes.

The above-mentioned predetermined time can advantageously be set by a mobile device, such as a phone communicating with the authentication means provided on the case.

According to a further preferred embodiment, the aerosol generating system is configured so that the movement for taking the vaporizer from the case for example starts with a tilting movement. This allows a compact design of the aerosol generating system.

Further, the vaporizer may be nested in a recess of the case. In addition, a gap may be provided at a lower end of the recess so that the user can apply pressure at the lower end of the vaporizer for tilting the vaporizer about a step. Consequently, the vaporizer is held in a nested position, when accommodated in the case. Further, such a configuration is easy to handle for removing the vaporizer and self-explanatory for the user.

The invention also provides a method of using an aerosol generating system, in which removal of the vaporizer from the case is enabled only in the event of a positive authentication result obtained from an authentication interface and/or disabled in the event of a negative authentication result. This achieves the same advantages as those noted above with regard to the underlying system. It should be mentioned in this context, that any features described above and below with reference to the system can be applied to the method and vice versa.

BRIEF DESCRIPTION OF THE DRAWINGS

Hereinafter, preferred embodiment of the invention will be described in detail with reference to the drawings, in which.

DETAILED DESCRIPTION OF PREFERRED EMBODIMENTS

Figure 1:
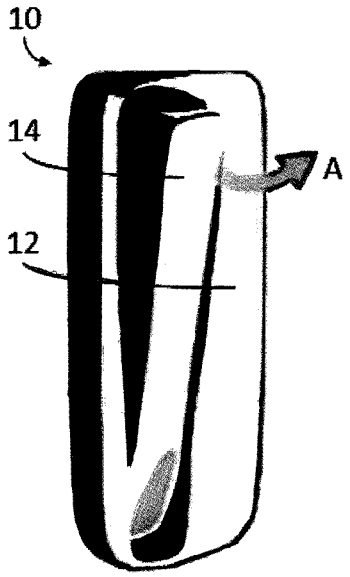
FIG. 1 shows a perspective view of a first embodiment.

In the embodiment of an aerosol generating system 10 shown in FIG. 1 vaporizer 14 is nested in an appropriate recess 18 (see FIGS. 2 and 3) of a case 12. Due to an appropriate gap (not visible) at the (according to FIG. 1) lower end of the recess 18, the user can apply pressure at the lower end of the vaporizer and it will then tilt about a step (not visible in figure) as indicated by arrow A, so that it can be removed.

Figure 2:
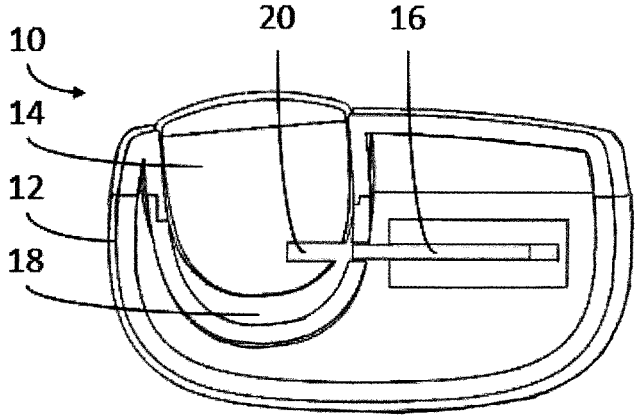
FIG. 2 shows a cut view of the first embodiment in an unlocked state.
Figure 3:
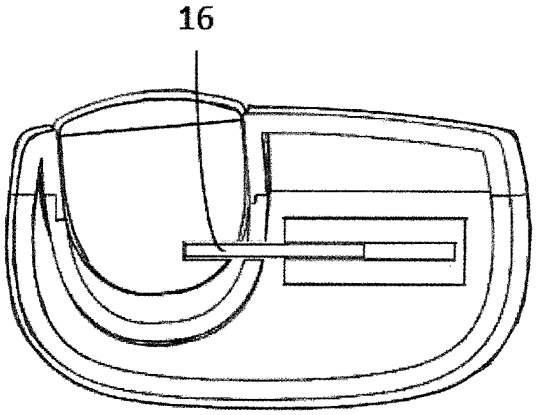
FIG. 3 shows the embodiment of FIG. 1 in a locked state.

As shown in more detail in FIGS. 2 and 3, the vaporizer 14 comprises a groove 20, which can also be formed as a hole or any other type of recess, which a pin 16 (example of a first locking or blocking element) can enter. The pin 16 is slidable within the case 12 and can particularly be slid into a position protruding into the recess 18.

As can be taken from FIG. 3, when the vaporizer 14 is placed in the recess 18, its removal can be blocked by the pin 16 engaging the groove 20. In particular, the pin 16 can be adapted to only be retracted into the position shown in FIG. 2 in the case of a positive authentication results so as to allow removal of the vaporizer 14 from the case 12 only under such circumstances. Thus, the pin 16 constitutes the locking element or member, and the combination of pin 16 and groove 20 in this case constitutes the authentication means, and retraction of the pin 16 may for example be controlled by a suitable controller, such as a main control unit on a printed circuit board. The controller typically receives authentication information from an authentication interface such as a fingerprint sensor or a wireless communication interface and appropriately controls the movement of the pin 16. Movement as such can for example be effected by at least one magnet, solenoid or motor. In particular, a solenoid can be used to effect linear movement of the pin 16. All of the above details regarding control and effecting movement also apply to the embodiments described below. In the case of pivotable authentication means as described below, an electric motor is particularly suitable, but a shape memory alloy can also be used. This also applies to any kind of electric lock.

Further, since the vaporizer 14 is in this case fully nested within recess 18 of the case 12, removal thereof will typically be initiated by tilting. Such a movement can also be blocked by a suitable, removable, in particular retractable blocking member which can be present in the space between vaporizer 14 and the bottom of the recess 18 visible in FIGS. 2 and 3 in line with the gist of the invention. In particular, as long as such a blocking member blocks the gap or space, which the vaporizer needs to enter for tilting, this movement is blocked and since no portion of the vaporizer 14 allowing grasping thereof is exposed, it cannot be taken out of the case 12. Such a blocking member then constitutes the authentication means.

Figure 4:
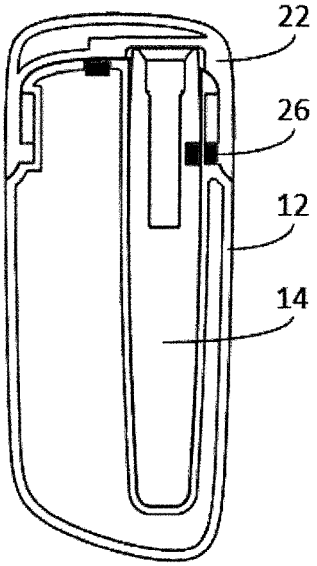
FIG. 4 shows a second embodiment in a front view.

The same effect is achieved, according to the embodiment of FIGS. 4 to 7, by blocking the door or lid 22 of the case 12 which allows access to a vaporizer 14 as shown in FIG. 4 in a cut view. Although details of the lid 22 and a hinge 26 differ between FIG. 4 on the one hand and FIGS. 5 and 6 on the other hand, the principle regarding a pivotable lid remains the same.

In particular, the lid 22 can be opened by pivoting in (according to FIGS. 5 and 6) counterclockwise direction about a hinge 26. In the situation shown in FIG. 5 the pivotable hook 24 (example of a second locking or blocking element) does not engage an appropriate groove 20 provided on the lid 22, so that the lid can be opened, and the vaporizer can be removed, as shown in FIG. 7.

Figure 6:
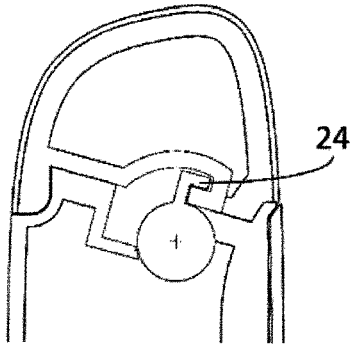
FIG. 6 shows the embodiment of FIG. 4 in a locked state.
Figure 7:
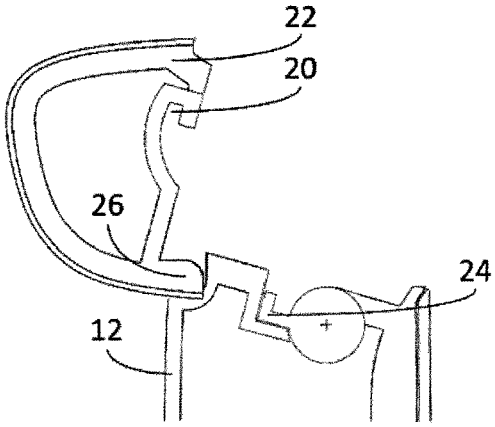
FIG. 7 shows the embodiment of FIG. 4 with an opened lid.

However, as shown in FIG. 6, when the hook has been pivoted, in the case shown about a quarter circle in clockwise direction, the closed lid is blocked and removal of the vaporizer is prevented. Thus, the hook constitutes a locking element member, and the combination of hook 24 and groove 20 in this case constitutes the authentication means.

Figure 5:
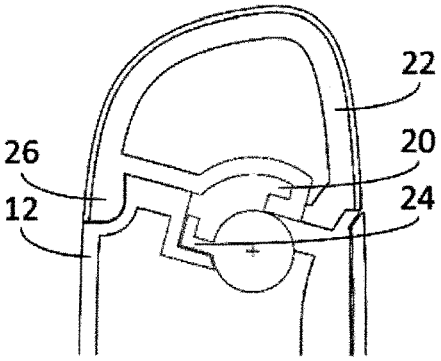
FIG. 5 shows a portion of the second embodiment in an unlocked state.
Figure 8:
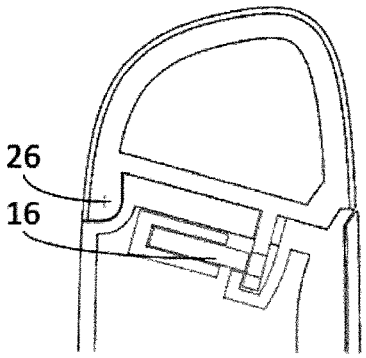
FIG. 8 shows a third embodiment in an unlocked state.
Figure 9:
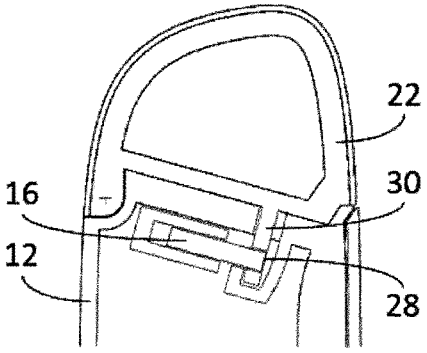
FIG. 9 shows the embodiment of FIG. 8 in a locked state.
Figure 10:
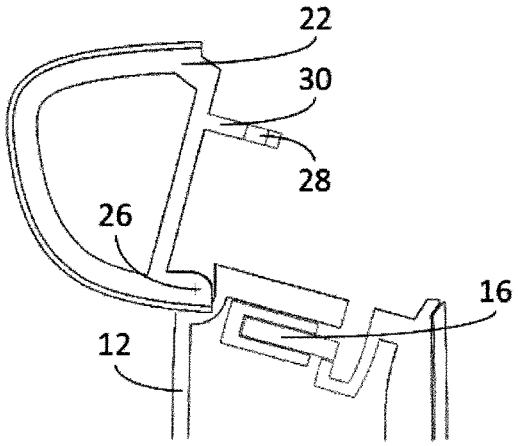
FIG. 10 shows the embodiment of FIG. 8 with an opened lid.

The embodiment of FIG. 8 essentially corresponds to that of the embodiment of FIG. 5, but in this case a slidable pin 16 similar to that of the first embodiment is provided in order to block the lid 22 as shown in FIG. 9. In particular, in this situation, the pin 16 has entered an appropriate groove or hole 28 provided in the lid 22, in the embodiment shown in a lug 30 protruding towards the remainder of the case 12, so that the lid 22 cannot be opened. In contrast, FIG. 10 shows the opened lid, which is enabled by retraction of the pin 16.

The invention claimed is:

1. An aerosol generating system comprising a case and a vaporizer, the case having an authentication device adapted to enable removal of the vaporizer from the case only in an event of a positive authentication result and disable removal of the vaporizer from the case in the event of a negative authentication result, wherein removal of the vaporizer is disabled by at least one first locking or blocking element engaging the vaporizer.

2. The aerosol generating system of claim 1, further comprising at least one authentication interface provided on the case and/or a mobile device.

3. The aerosol generating system of claim 2, wherein the at least one authentication interface is based on RFID, Bluetooth and/or biometric detection.

4. The aerosol generating system of claim 1, wherein removal of the vaporizer is disabled by an element having a shape memory alloy and/or an electric lock having at least one magnet, solenoid and/or motor adapted to actuate a lock by electric power being supplied or removed.

5. The aerosol generating system of claim 1, wherein the at least one first locking or blocking element is slidable and/or pivotable.

6. The aerosol generating system of claim 1, wherein the vaporizer comprises a recess, and wherein the locking or blocking element is a pin arranged to enter the recess.

7. The aerosol generating system of claim 1, wherein removal of the vaporizer is disabled by at least one second locking or blocking element engaging a door or lid associated with a chamber or recess accommodating the vaporizer and/or that blocks movement thereof.

8. The aerosol generating system of claim 7, wherein the at least one second locking or blocking element is slidable and/or pivotable.

9. The aerosol generating system of claim 1, wherein the authentication device is adapted to disable removal of the vaporizer after a predetermined time after detection of the vaporizer.

10. The aerosol generating system of claim 9, wherein the predetermined time is set by a mobile device.

11. The aerosol generating system of claim 1, wherein the vaporizer is nested in a recess of the case and wherein a gap is provided at a lower end of the recess configured to allow a user to apply pressure at the lower end of the vaporizer for tilting the vaporizer about a step.

12. A method of using an aerosol generating system comprising a case and a vaporizer, in which removal of the vaporizer from the case is enabled only in the event of a positive authentication result obtained from an authentication interface and disabled in the event of a negative authentication result, the method comprising disabling removal of the vaporizer by engaging at least one first locking or blocking element with the vaporizer.

13. The method of claim 12, wherein the at least one first locking or blocking element is slid in order to enable removal of the vaporizer.

14. The method of claim 12, wherein the vaporizer comprises a recess, and wherein the locking or blocking element is a pin arranged to enter the recess.

15. The method of claim 13, wherein at least one second locking or blocking element is pivoted to enable removal of the vaporizer.

16. The method of claim 12, wherein an authentication device disables removal of the vaporizer after a predetermined time after detection of the vaporizer.

17. The method of claim 16, wherein the predetermined time is set by a mobile device.

18. The method of claim 12, wherein the movement for taking the vaporizer from the case starts with a tilting movement.

19. The method of claim 12, wherein the vaporizer is nested in a recess of the case and wherein a gap is provided at a lower end of the recess, and wherein the user applies pressure at the lower end of the vaporizer so that the vaporizer then tilts about a step.

20. The aerosol generating system of claim 1, further comprising at least one authentication interface provided on the case.

21. The aerosol generating system of claim 1, further comprising a fingerprint reader provided on the case.

22. The aerosol generating system of claim 1, wherein removal of the vaporizer is disabled by an electric lock having at least one magnet, solenoid and/or motor adapted to actuate a lock by electric power being supplied or removed.

23. An aerosol generating system comprising:

a case comprising a movable pin; and a vaporizer comprising a recess configured to receive the movable pin, wherein removal of the vaporizer from the case is disabled by the movable pin of the case engaging the recess of the vaporizer in the event of a negative authentication result.

* * * * *